United States Patent [19]

Arthur, Jr. et al.

[11] 3,989,454

[45] Nov. 2, 1976

[54] PROCESS FOR CONTROLLING THE MACROMOLECULAR REACTIVITIES OF COTTON AND MERCERIZED COTTON

[75] Inventors: Jett C. Arthur, Jr., Metairie, La.; Yoshio Nakamura, Kiryu, Japan; Oscar Hinojosa, Metairie, La.

[73] Assignee: The United States of America as represented by the Secretary of Agriculture, Washington, D.C.

[22] Filed: Sept. 28, 1973

[21] Appl. No.: 401,773

[52] U.S. Cl. ..... 8/120; 204/159.12; 204/160.1; 260/17.4 CL

[51] Int. Cl.[2] ..... D06M 13/20

[58] Field of Search ..... 8/120; 204/159.12, 160.1; 260/17.4 CL

[56] References Cited

OTHER PUBLICATIONS

Nakamura et al., I–Cellulose–Graft Copolymers–J. of App. Pol. Sci., vol. 13, pp. 2633–2641, (1969).

Nakamura et al., II–Cellulose Graft Copolymers–J. of App. Pol. Sci., vol. 14, pp. 789–797, (1970).

Nakamura et al., III–Cellulose Graft Copolymers–J. of App. Pol. Sci., vol. 15, pp. 391–401, (1971).

Byrne et al. – J. of App. Pol. Sci., vol. 14, pp. 3093–3103, (1970).

*Primary Examiner*—Carman J. Seccuro

*Attorney, Agent, or Firm*—M. Howard Silverstein; Salvador J. Cangemi

[57] ABSTRACT

Grafted cotton-poly(ethyl acrylate) copolymer and grafted mercerized cotton-poly(ethyl acrylate) copolymer have been prepared by a process which equates their reactivity. The process discloses the reaction of irradiated cotton and irradiated mercerized cotton with certain solutions of ethyl acrylate in either water, methanol, or mixtures thereof to yield the copolymer derivatives which have responded equally and do respond equally to further treatments.

1 Claim, 4 Drawing Figures

Figure 1:
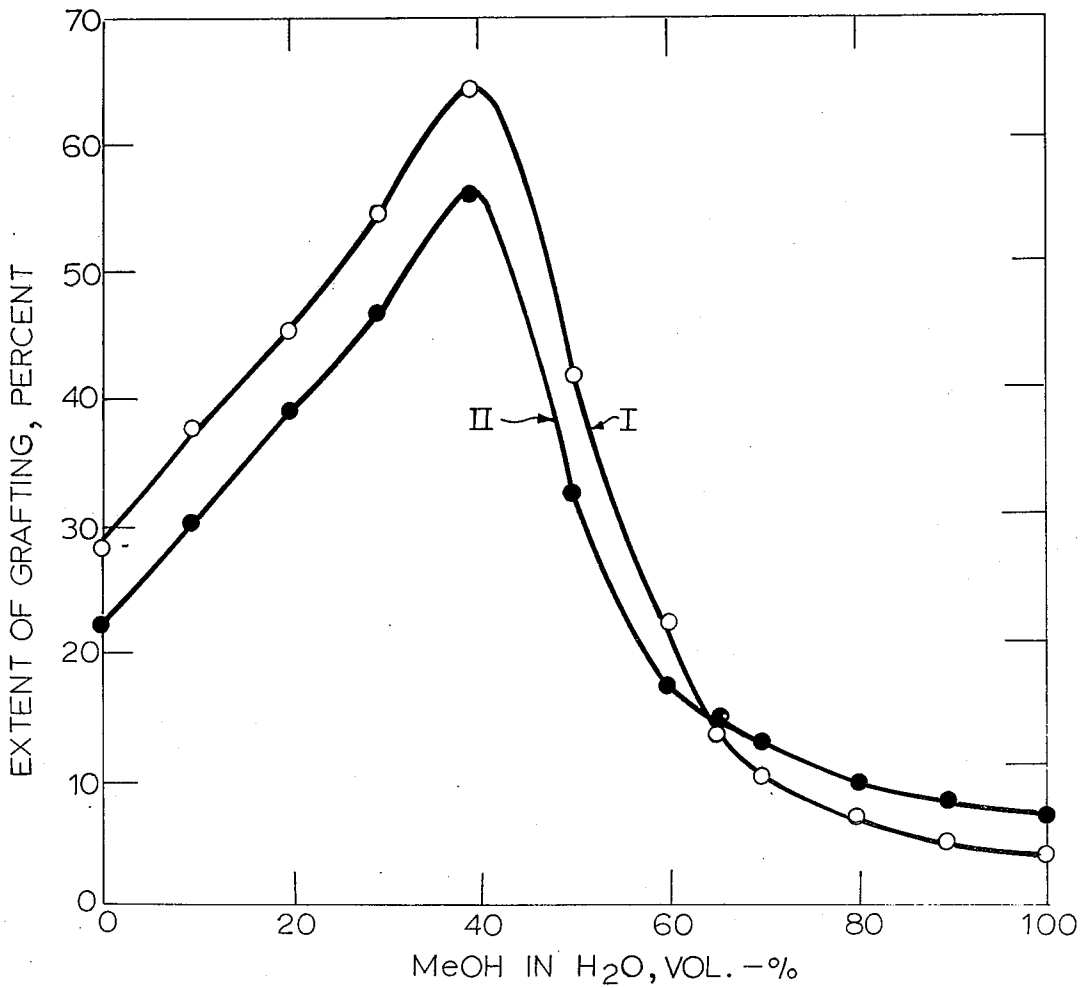

PROCESS FOR CONTROLLING THE MACROMOLECULAR REACTIVITIES OF COTTON AND MERCERIZED COTTON

A non-exclusive, irrevocable, royalty-free license in the invention herein described, throughout the world for all purposes of the United States Government, with the power to grant sublicenses for such purposes, is hereby granted to the Government of the United States of America.

This invention relates to a process for controlling the macromolecular reactivities of cotton and mercerized cotton. More particularly, this invention relates to a process for controlling the reactivities of macrocellulosic free radicals that are formed in cotton and mercerized cotton on exposure to high energy ionizing radiation and that are used to initiate graft polymerization reactions. Specifically, this invention refers to a process for simplifying the textile finishing of cotton and mercerized cotton, so that one finishing procedure for both cotton and mercerized cotton may be used to produce textile fiber copolymers of cotton and mercerized cotton with equal amounts of grafted polymers and with equal reactivities for subsequent textile finishing treatments, such as dyeing, crosslinking, thermoplasticizing and the like. The application of the process of this invention in a textile finishing plant would have the obvious advantages of simplifying unit operations and of producing textile fiber copolymers of cotton and mercerized cotton with equal reactivities to subsequent textile finishing treatment, such as dyeing, crosslinking, thermoplasticizing and the like thereby simplifying overall textile finishing plant unit operations including processing, production of textile products, and control and environmentally acceptable disposition of plant effluents.

The method of this invention has as its objective: (1) the selective control of the reactivities of macrocellulosic radicals formed in cotton and mercerized cotton on exposure to high energy ionizing gamma-radiation from cobalt-60; (2) the use of one type of vinyl monomer-solvent solution in which to immerse the irradiated cotton and irradiated mercerized cotton to initiate graft polymerization, for example, said monomer being ethyl acrylate and solvent being composed of methanol and water; (3) control of the rate and extent of polymerization reactions of irradiated cotton and irradiated mercerized cotton with ethyl acrylate from methanol—water solutions, so that after any period of reaction copolymers of cotton textile fibers and copolymers of mercerized cotton textile fibers have the same composition, that is, each derived copolymer textile fiber has the same concentration of cellulose and copolymer composing said textile fibers; (4) thereby simplifying unit operations in textile finishing plants that normally process both cotton and mercerized cotton.

BACKGROUND

The differences in the reactivity of cotton and mercerized cotton to chemical modification, dyeing, crosslinking reactions, graft polymerization, and the like are well-known in textile finishing. The rate and extent of these textile finishing processes in these heterogeneous wet systems are dependent on whether the reactions are being conducted with cotton or mercerized cotton. The crystal lattice type of natural cotton is cellulose I with a beta angle of about 84° and a crystallinity index of about 80 percent. The crystal lattice type of mercerized cotton is cellulose II with a beta angle of about 62° and a crystallinity index of about 60 percent. Chemical modification, dyeing, crosslinking reactions and the like occur to a greater extent with mercerized cotton than with cotton. Since the rate and extent of these reactions are dependent on the crystallinity index and the related accessibility of the hydroxyl groups of the cellulose molecule to the chemical reagents and dyes, the lower crystallinity index and lattice type of mercerized cotton as compared with the higher crystallinity index and lattice type of cotton accounts for the higher reactivity of mercerized cotton as compared with the lower reactivity of cotton.

Macromolecular modifications of cotton and mercerized cotton have been investigated extensively. Macromolecular modifications of cotton and mercerized cotton are dependent on free radical initiated reactions, that is, graft polymerization reactions. To obtain maximum yield of cellulose graft copolymer, as compared with homopolymer formation, the initiating radical is formed on the cellulose molecule. When cotton and mercerized cotton are exposed to high energy ionizing gamma-radiation from cobalt-60, trapped macrocellulosic radicals are formed in cotton and mercerized cotton on the cellulose molecule. When pre-irradiated cotton and mercerized cotton are immersed in solutions of vinyl monomers, graft polymerization reactions are initiated. The rate and extent of graft polymerization reactions in these heterogeneous systems are dependent on conditions of storage of irradiated cotton and irradiated mercerized cotton prior to immersion in the solutions, composition of the solutions, reaction time, agitation during the reaction, the cellulose crystal lattice type, and the crystallinity index.

Cotton and mercerized cotton are the two forms of cotton textile products used commercially. To simplify textile finishing control and textile finishing processes it would be desirable to have one treating procedure and one treating solution or bath for both cotton and mercerized cotton that would yield from each of the cotton and mercerized cotton textile products with equal amounts of modifications per unit weight of cellulose and equal reactivities of the desired textile products for further textile finishing treatments and uses. Simplified one procedure and one bath textile finishing treatments for the chemical modification, dyeing, crosslinking reactions, graft polymerization reactions, and the like for cotton and mercerized cotton to yield derived textile products from cotton and mercerized cotton with equal amounts of changes in composition and equivalent reactivities for further textile finishing treatments and uses have not been accomplished.

THE INVENTION

The instant invention defines a process whereby cotton and mercerized cotton are treated by one treating procedure and one treating solution or bath to yield derived textile products with equal amounts of changes in composition and equal reactivities. Further the instant invention defines a process whereby cotton can be made more reactive than mercerized cotton by using one treating procedure and one treating solution or bath to yield derived textile products in which cotton is modified to a greater extent than mercerized cotton. Further the instant invention defines a process whereby mercerized cotton can be made more reactive than cotton by using one treating procedure and one treating solution or bath to yield derived textile products in which mercerized cotton is modified to a greater extent than cotton.

Samples of cotton of the Deltapine variety were spun into 7s/3 yarns and purified in the usual manner. The purified cotton yarn had a molecular weight of about 700,000 and a crystal lattice type Cellulose I. Mercerized cotton was produced from these cotton yarns in the usual manner by immersing samples of cotton in sodium hydroxide solution (23 percent concentration) at 25° C for 20 minutes under slack conditions, then washed free of sodium hydroxide in the usual manner, and dried at 25° C. Mercerized cotton yarn had a crystal lattice type Cellulose II. Samples of cotton and mercerized cotton yarns were dried for 17 hours under vacuum at 50° C to a moisture content of less than 2 percent, then placed in sample tubes under a nitrogen atmosphere, and irradiated by exposing the samples to high-energy ionizing gamma-radiation from cobalt-60 at 25° C to a dosage of 1 megarad. Samples of irradiated cotton yarns and irradiated mercerized cotton yarns (1 part by weight) were immersed in solvents (33 parts by weight) of methanol, water, and methanol (10 to 90 volume-percent)-water (90 to 10 volume-percent) containing ethyl acrylate monomer (9 volume-percent) in solvent (91 volume-percent) for 15 to 180 minutes at 25° C under an atmosphere of nitrogen. After the desired reaction time, the samples were washed with methanol at 25° C to remove unreacted ethyl acrylate, and then the washed samples were extracted with acetone at 55° C for 50 hours to remove homopolymer. The derived cotton-poly(ethyl acrylate) and mercerized cotton-poly(ethyl acrylate) copolymer yarns were washed with distilled water and dried under vacuum at 50° C. The extents of macromolecular modifications of cotton and mercerized cotton yarns were determined as the increased in the weights of the grafted cotton-poly(ethyl acrylate) and mercerized cotton-poly(ethyl acrylate) copolymer yarns over those of control cotton and mercerized cotton yarns.

A detaild report of the present invention appears in the Journal of Polymer Science, Part C, No. 37, pp. 47–55 (October 1972) in an article by Nakamura, Hinojosa, and Arthur bearing the title "Graft Copolymerization of Ethyl Acrylate with gamma-irradiated Cotton Cellulose I and II."

The following examples are provided to facilitate the comprehension of the invention and should not be construed as limiting the invention in any manner whatsoever.

EXAMPLES 1 and 2

A graphic study of the effect of composition of methanol-water solvent on extent of graft copolymerization of ethyl acrylate with irradiated cotton (I) and irradiated mercerized cotton (II) is presented in FIG. 1.

By the method as described in the specification above, irradiated cotton yarn (1 part by weight) was immersed in solvents (33 parts by weight) of methanol, water, and methanol (10 to 90 volume-percent)—water (90 to 10 volume-percent) containing ethyl acrylate monomer (9 volume-percent) in solvent (91 volume-percent) for 60 minutes at 25° C under an atmosphere of nitrogen. Then the samples were washed with methanol at 25° C to remove unreacted ethyl acrylate, and then washed samples were extracted with acetone at 55° C for 50 hours to remove homopolymer. The derived cotton-poly(ethyl acrylate) copolymer yarns were washed with distilled water and dried under vacuum at 50° C. The extent of grafting, that is, macromolecular modification, of irradiated cotton yarn as a function of the composition of methanol-water solvent is shown in Example 1 (I). Note: I identified cotton cellulose I lattice type. By the method of Example 1 (I), the extent of grafting from water was 28 percent; from methanol, 3 percent; from methanol (10 to 90 volume-percent)-water (90 to 10 volume-percent), 38 to 4 percent, with a maximum extent of grafting from methanol (40 volume-percent)-water (60 volume-percent) of 65 percent.

By the method as described in the specification above and by the method of Example 1 (I), irradiated mercerized cotton yarn (1 part by weight) was immersed in solvents (33 parts by weight) of methanol, water, and methanol (10 to 90 volume-percent)-water (90 to 10 volume-percent) containing ethyl acrylate monomer (9 volume-percent) in solvent (91 volume-percent) for 60 minutes at 25° C under an atmosphere of nitrogen. Then the samples were washed with methanol at 25° C to remove unreacted ethyl acrylate, and then the washed samples were extracted with acetone at 55° C for 50 hours to remove homopolymer. The derived mercerized cotton-poly(ethyl acrylate) copolymer yarns were washed with distilled water and dried under vacuum at 50° C. The extent of grafting, that is, macromolecular modification, of irradiated mercerized cotton yarn as a function of the composition of methanol-water solvent is shown in Example 2 (II). Note: II identifies mercerized cotton Cellulose II lattice type. By the method of Example 2 (II), the extent of grafting from water was 21 percent; from methanol, 6 percent; from methanol (10 to 90 volume-percent)-water (90 to 10 volume-percent), 30 to 7 percent, with a maximum extent of grafting from methanol (40 volume-percent)-water (60 volume-percent) of 55 percent.

EXAMPLES 3 and 4

Figure 2:
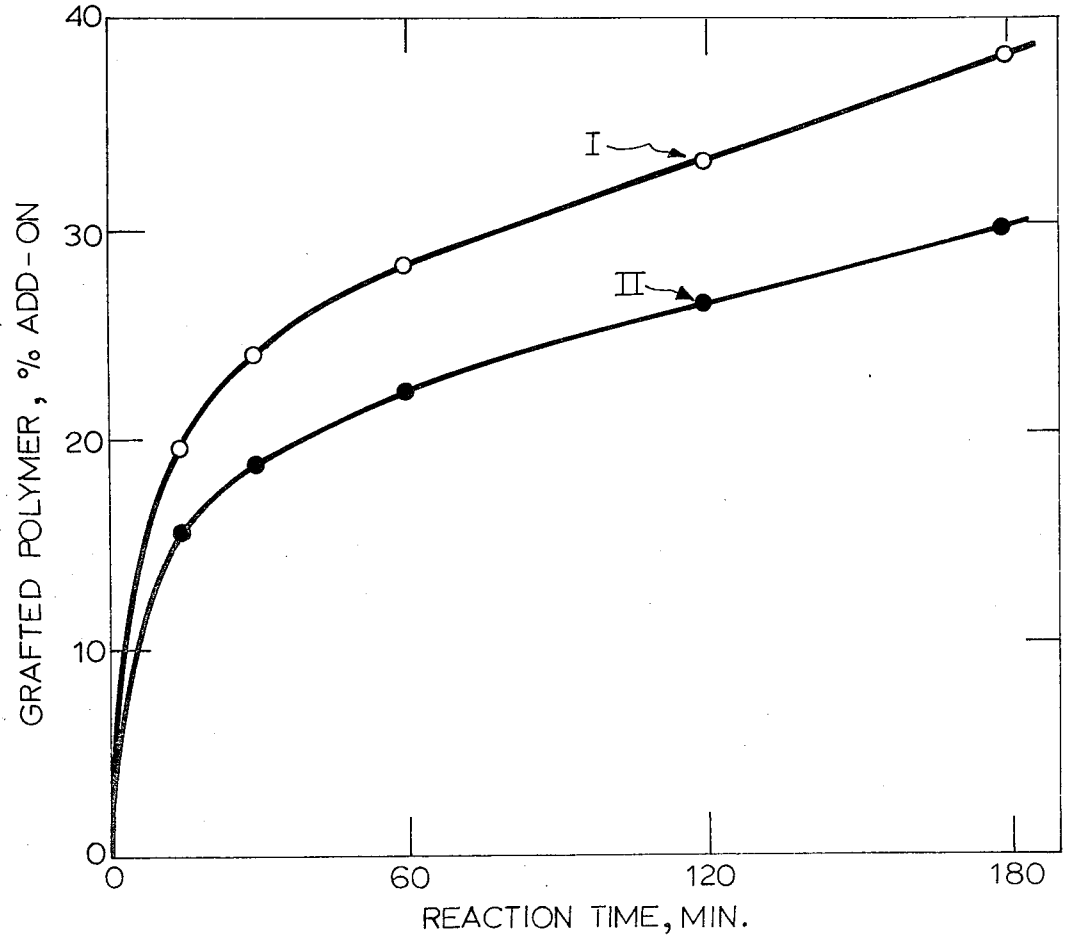

A graphic study of the effect of reaction time on extent of graft copolymerization of ethyl acrylate from water at 25° with irradiated cotton (I) and irradiated mercerized cotton (II) is presented in FIG. 2.

By the method as described in the specification above, irradiated cotton yarn (1 part by weight) was immersed in water (33 parts by weight) containing ethyl acrylate monomer (9 volume-percent) in water (91 volume-percent) for 15 to 180 minutes at 25° C under an atmosphere of nitrogen. Then the samples were washed with methanol at 25° C to remove unreacted ethyl acrylate, and then washed samples were extracted with acetone at 55° C for 50 hours to remove homopolymer. The derived cotton-poly(ethyl acrylate) copolymer yarns were washed with distilled water and dried under vacuum at 50° C. The extent of grafting, that is, macromolecular modification, of irradiated cotton yarn as a function of reaction time is shown in Example 3 (I). By the method of Example 3 (I) the extent of grafting from water in the reaction time range of 15 to 180 minutes was 20 to 38 percent.

By the method as described in the specification above, irradiated mercerized cotton yarn (1 part by weight) was immersed in water (33 parts by weight) containing ethyl acrylate monomer (9 volume-percent) in water (91 volume-percent) for 15 to 180 minutes at 25° C under an atmosphere of nitrogen. Then the samples were washed with methanol at 25° C to remove unreacted ethyl acrylate, and then the washed samples were extracted with acetone at 55° C for 50 hours to remove homopolymer. The derived mercerized cotton-poly(ethyl acrylate) copolymer yarns were washed with distilled water and dried under vacuum at 50° C. The extent of grafting, that is, macromolecular modification, of irradiated mercerized cotton yarn as a function of reaction time is shown in Example 4 (II). By the method of Example 4 (II) the extent of grafting from water in the reaction time range of 15 to 180 minutes was 15 to 30 percent.

EXAMPLES 4 and 5

Figure 3:
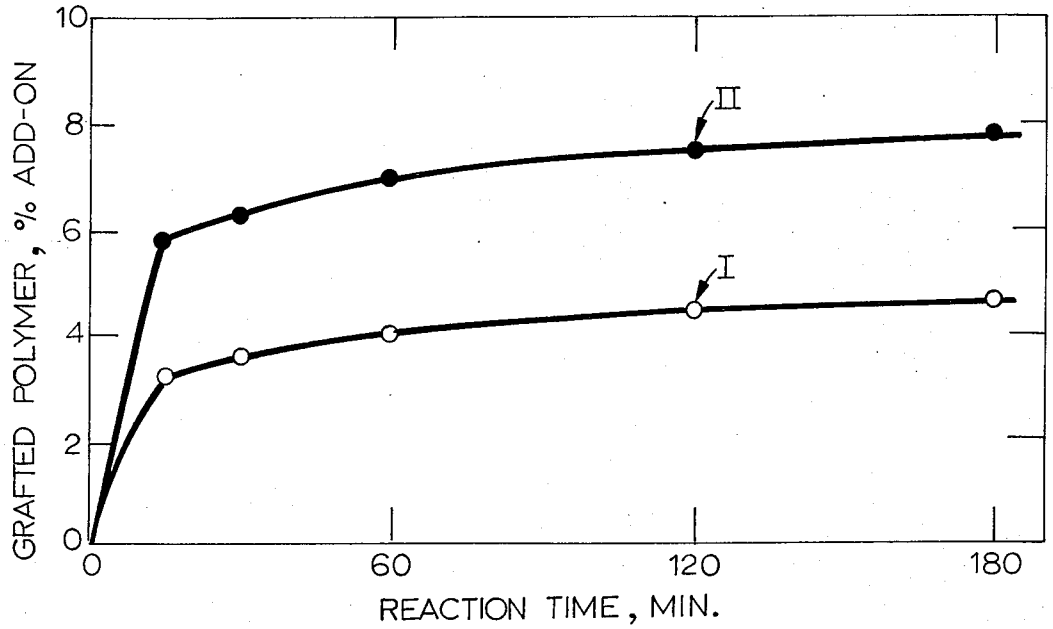

A graphic study of the effect of reaction time on extent of graft copolymerization of ethyl acrylate from methanol at 25° C with irradiated cotton (I) and irradiated mercerized cotton (II) is presented in FIG. 3.

By the method as described in the specification above, irradiated cotton yarn (1 part by weight) was immersed in methanol (33 parts by weight) containing ethyl acrylate monomer (9 volume-percent) in methanol (91 volume-percent) for 15 to 180 minutes at 25° C under an atmosphere of nitrogen. Then the samples were washed with methanol at 25° C to remove unreacted ethyl acrylate and then the washed samples were extracted with acetone at 55° C for 50 hours to remove homopolymer. The derived cotton-poly(ethyl acrylate) copolymer yarns were washed with distilled water and dried under vacuum at 50° C. The extent of grafting, that is, macromolecular modification, of irradiated cotton yarn as a function of reaction time is shown in Example 5 (I). By the method of Example 5 (I) the extent of grafting from water in the reaction time range of 15 to 180 minutes was 3.5 to 4.5 percent.

By the method as described in the specification above, irradiated mercerized cotton yarn (1 part by weight) was immersed in methanol (33 parts by weight) containing ethyl acrylate monomer (9 volume-percent) in methanol (91 volume-percent) for 15 to 180 minutes at 25° C under an atmosphere of nitrogen. Then the samples were washed with methanol at 25° C to remove unreacted ethyl acrylate, and then the washed samples were extracted with acetone at 55° C for 50 hours to remove homopolymer. The derived mercerized cotton-poly(ethyl acrylate) copolymer yarns were washed with distilled water and dried under vacuum at 50° C. The extent of grafting, that is, macromolecular modification, of irradiated mercerized cotton yarn as a function of reaction time is shown in Example 6 (II). By the method of Example 6 (II) the extent of grafting from methanol in the reaction time range of 15 to 180 minutes was 6 to 8 percent.

EXAMPLES 7 and 8

Figure 4:
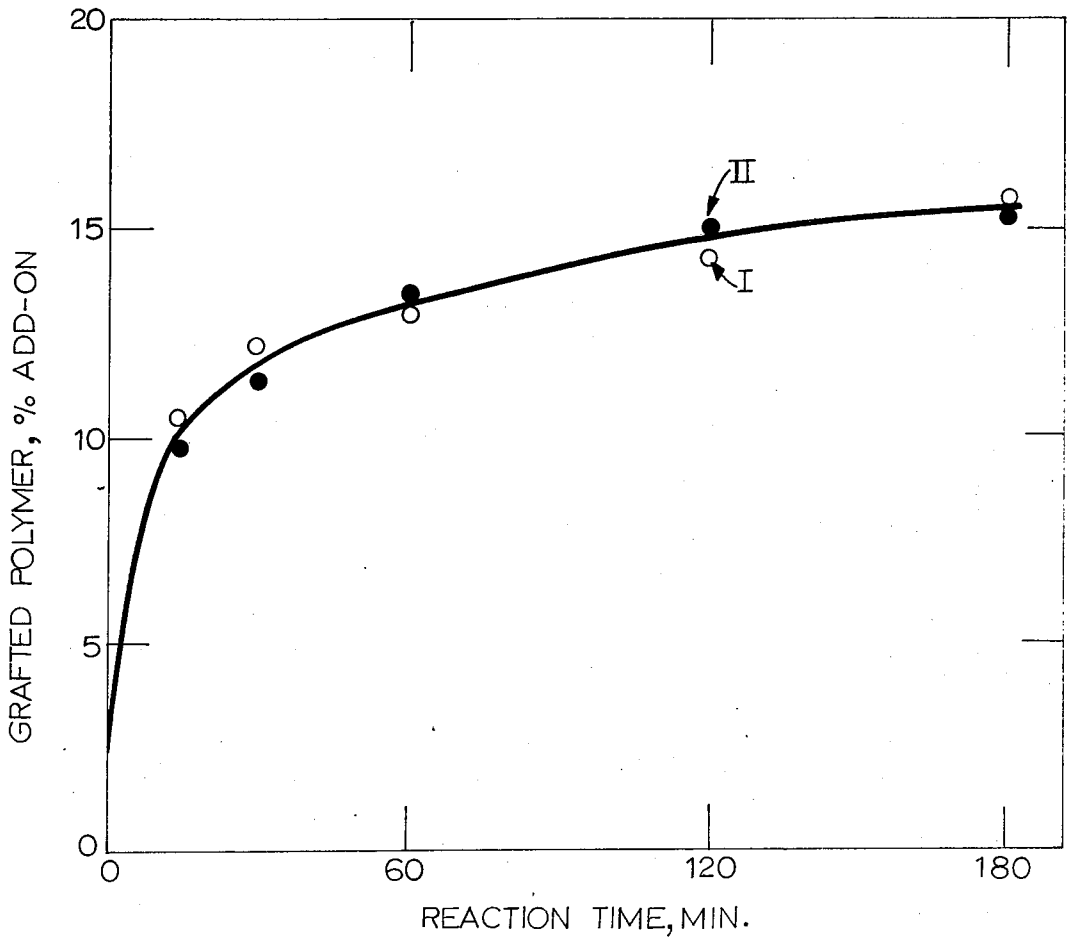

A graphic study of the effect of reaction time on extent of graft copolymerization of ethyl acrylate from methanol (65% by volume) and water (35% by volume) at 25° C with irradiated cotton (I) and irradiated mercerized cotton (II) is presented in FIG. 4.

By the method as described in the specification above, irradiated cotton yarn (1 part by weight) was immersed in methanol (65 volume-percent)-water (35 volume-percent) solvent containing ethyl acrylate monomer (9 volume-percent) in solvent (91 volume-percent) for 15 to 180 minutes at 25° C under an atmosphere of nitrogen. Then the samples were washed with methanol at 25° C to remove unreacted ethyl acrylate, and then the washed samples were extracted with acetone at 55° C for 50 hours to remove homopolymer. The derived cotton-poly(ethyl acrylate) copolymer yarns were washed with distilled water and dried under vacuum at 50° C. The extent of grafting, that is, macromolecular modification, of irradiated cotton yarn as a function of reaction time is shown in Example 7 (I). By the method of Example 7 (I) the extent of grafting from methanol (65 volume-percent)-water (35 volume-percent) solvent in the reaction time range of 15 to 180 minutes was 10 to 16 percent.

By the method as described in the specification above, irradiated mercerized cotton yarn (1 part by weight) was immersed in methanol (65 volume-percent)-water (35 volume-percent) solvent containing ethyl acrylate monomer (9 volume-percent) in solvent (91 volume-percent) for 15 to 180 minutes at 25° C under an atmosphere of nitrogen. Then the samples were washed with methanol at 25° C to remove unreacted ethyl acrylate, and then the washed samples were extracted with acetone at 55° C for 50 hours to remove homopolymer. The derived mercerized cotton-poly(ethyl acrylate) copolymer yarns were washed with distilled water and dried under vacuum at 50° C. The extent of grafting, that is, macromolecular modification, of irradiated mercerized cotton yarn as a function of reaction time is shown in Example 8 (II). By the method of Example 8 (II) the extent of grafting from methanol (65 volume-percent)-water (35 volume-percent) solvent in the reaction time range of 15 to 180 minutes was 10 to 16 percent.

It will be noted: (I) that by the methods of Examples 3 (I) and 4 (II) irradiated cotton is more reactive macromolecularly than irradiated mercerized cotton; (2) that by the methods of Examples 5 (I) and 6 (II) irradiated mercerized cotton is more reactive macromolecularly than irradiated cotton; and (3) that by the methods of Examples 7 (I) and 8 (II) irradiated mercerized cotton and irradiated cotton are equally reactive macromolecularly.

We claim:

1. In a process for producing cotton-poly(ethyl acrylate) copolymer textile and mercerized cotton-poly(ethyl acrylate) copolymer textile wherein cotton textile and mercerized cotton textile are dried, irradiated with ionizing radiation, impregnated with a solution of ethyl acrylate in a solvent consisting essentially of methanol and water, allowed to react with said ethyl acrylate, and the cotton-poly(ethyl acrylate) copolymer textile and the mercerized cotton-poly(ethyl acrylate) copolymer textile then recovered, the improvement which comprises employing one treating procedure for both cotton and mercerized cotton using one treating solution or both containing about 65 volume percent methanol and about 35 volume percent water in said solvent, thereby permitting cotton and mercerized cotton polymer textiles having the same grafted polymer add-on to be produced under the same reaction conditions when being treated simultaneously under the same conditions or being treated separately under the same reaction conditions, thereby producing cotton and mercerized cotton polymer textiles that have the same grafted polymer add-on.

* * * * *